US005205951A

United States Patent [19]

MacKinnon

[11] Patent Number: 5,205,951

[45] Date of Patent: * Apr. 27, 1993

[54] PHOSPHATE ESTER-BASED FUNCTIONAL FLUIDS CONTAINING AN EPOXIDE AND A COMPATIBLE STREAMING POTENTIAL-INHIBITING METAL SALT

[75] Inventor: Hugh S. MacKinnon, Hercules, Calif.

[73] Assignee: Chevron Research and Technology Company, San Francisco, Calif.

[ * ] Notice: The portion of the term of this patent subsequent to Jul. 30, 2008 has been disclaimed.

[21] Appl. No.: 692,770

[22] Filed: Apr. 29, 1991

Related U.S. Application Data

[63] Continuation-in-part of Ser. No. 511,494, Apr. 20, 1990, Pat. No. 5,035,824, which is a continuation of Ser. No. 329,743, Mar. 28, 1989, abandoned, which is a continuation of Ser. No. 158,178, Feb. 19, 1988, abandoned, which is a continuation of Ser. No. 68,075, Jun. 30, 1987, abandoned.

[51] Int. Cl.[5] ..... C10M 105/74; C10M 129/18

[52] U.S. Cl. ..... 252/78.5; 252/49.8; 252/49.9; 252/75

[58] Field of Search ..... 252/78.5, 75, 49.8, 252/49.9

[56] References Cited

U.S. PATENT DOCUMENTS

| | | | |
|---|---|---|---|
| 2,470,792 | 5/1949 | Schlesinger et al. | 252/78 |
| 2,686,760 | 8/1954 | Watson | 252/78.5 |
| 3,352,780 | 11/1967 | Groslambert | 252/33.3 |
| 3,411,923 | 11/1968 | Bretz | 106/14 |
| 3,591,506 | 7/1971 | Peeler et al. | 252/78.1 |
| 3,592,772 | 7/1971 | Godfrey et al. | 252/75 |
| 3,597,359 | 8/1971 | Smith | 252/75 |
| 3,679,587 | 7/1972 | Smith | 252/78 |
| 3,707,501 | 12/1972 | Gentit et al. | 252/78 |
| 3,718,596 | 2/1973 | Richard, Jr. | 252/49.8 |
| 3,907,697 | 9/1975 | Burrous | 252/75 |
| 3,932,294 | 1/1976 | Burrous | 252/78.5 |
| 3,992,309 | 11/1976 | Dounchis | 252/49.8 |
| 4,206,067 | 6/1980 | MacKinnon | 252/75 |
| 4,252,662 | 2/1981 | Marolewski et al. | 252/78.5 |
| 4,302,346 | 11/1981 | MacKinnon | 252/78.5 |
| 4,324,674 | 4/1982 | MacKinnon | 252/78.5 |
| 4,797,219 | 1/1989 | Guttierrez et al. | 252/46.6 |
| 5,035,824 | 7/1991 | MacKinnon | 252/75 |

OTHER PUBLICATIONS

Chemical Abstracts, AN 113(6):46074g, "Corrosion Inhibitor for Protecting Cooling Water Circuits", Nowosz-Arkuszewska et al, Aug. 1987.

Chemical Abstracts, AN 113(2):11905b, "Improved Process for Preparation of Corrosion/Scale Inhibitors", Singh et al., Feb. 1989.

*Primary Examiner*—Christine Skane

*Attorney, Agent, or Firm*—W. K. Turner; J. J. DeYoung

[57] ABSTRACT

A functional fluid comprising an effective amount of a soluble streaming potential-inhibiting metal salt; an epoxide; and a major amount of a phosphate ester; wherein the metal salt is compatible with the epoxide component of the functional fluid at a temperature of about 260° F. and the functional fluid has a wall current of less than 0.15 microamperes.

21 Claims, No Drawings

PHOSPHATE ESTER-BASED FUNCTIONAL FLUIDS CONTAINING AN EPOXIDE AND A COMPATIBLE STREAMING POTENTIAL-INHIBITING METAL SALT

CROSS REFERENCE TO RELATED APPLICATIONS

This application is a continuation-in-part of Ser. No. 511,494, filed Apr. 20, 1990, now U.S. Pat. No. 5,035,824 which is a continuation of Ser. No. 329,743, filed Mar. 28, 1989, now abandoned, which is a continuation of Ser. No. 158,178, filed Feb. 19, 1988, now abandoned, which is a continuation of Ser. No. 068,075, filed Jun. 30, 1987, which is now abandoned.

BACKGROUND OF THE INVENTION

This invention relates to fluid compositions which are useful for transmitting power in hydraulic systems. Specifically, it relates to functional fluids having a tendency to cause erosion of hydraulic systems and a newly discovered means of controlling such erosion.

Organic phosphate ester-based functional fluids have been recognized for some time as advantageous for use as the power transmission medium in hydraulic systems. Such systems include recoil mechanisms, fluid-drive power transmissions, and aircraft hydraulic systems. In the latter, phosphate ester-based fluids find particular utility because of their special properties which include high viscosity index, low pour point, high lubricity, low toxicity, low density and low flammability. Thus, for some years, numerous types of aircraft, particularly commercial jet aircraft, have used phosphate ester-based fluids in their hydraulic systems. Other power transmission fluids which have been utilized in hydraulic systems include major or minor amounts of hydrocarbon oils, amides of phosphoric acid, silicate esters, silicones, and polyphenyl ethers.

Additives which perform special functions such as hydrolysis inhibition, viscosity index improvement and foam inhibition are also frequently present in hydraulic fluid. For example, epoxides are utilized commonly in phosphate ester-based hydraulic fluids to inhibit hydrolysis of the phosphate ester.

The hydraulic systems of a typical modern aircraft contain a fluid reservoir, fluid lines and numerous hydraulic valves which actuate various moving parts of the aircraft such as the wing flaps, ailerons, rudder and landing gear. In order to function as precise control mechanisms, these valves often contain passages or orifices having clearances on the order of a few thousandths of an inch or less through which the hydraulic fluid must pass. In a number of instances, valve orifices have been found to be substantially eroded by the flow of hydraulic fluid. Erosion increases the size of the passage and reduces below tolerable limits the ability of the valve to serve as a precision control device. Many aircraft have experienced sagging wing flaps during landings and takeoffs as a result of valve erosion. Thus, a need exists for functional fluid additives which prevent or inhibit the erosion of hydraulic system valves.

Early investigations indicated that valve erosion was caused by cavitation in the fluid as the fluid passed at high velocity from the high-pressure to the low-pressure side of the valve. Efforts to control hydraulic valve erosion by treating the problem as one of cavitation in the fluid are described in Hampton, "The Problem of Cavitation Erosion in Aircraft Hydraulic Systems", Aircraft Engineering, XXXVIII, No. 12 (December, 1966).

Subsequent studies determined that certain valve erosions are associated with the electrokinetic streaming current induced by high-velocity fluid flow. Studies which attribute valve erosion to the streaming current induced by fluid flow include Beck et al., "Corrosion of Servovalves by an Electrokinetic Streaming Current", Boeing Scientific Research Document D1-82-0839 (September, 1969) and Beck et al., "Wear of Small Orifice by Streaming Current Driven Corrosion", Transactions of the ASME, Journal of Basic Engineering, pages 782–791 (December, 1970).

The rate of valve erosion in aircraft hydraulic system valves has been found to vary with the electrical streaming potential of the hydraulic fluid passing through the valve. Streaming potential is defined on pages 4–30 of the Electrical Engineers Handbook, by Pender and Del Mar (New York, Wiley, 1949) as the electromotive force (EMF) created when a liquid is forced by pressure through an orifice. Streaming potential is a function of several factors including the electrical properties and viscosity of the liquid, the applied pressure, and the physical characteristics of the orifice.

A number of methods are disclosed in the patent literature for reducing or inhibiting valve erosion in hydraulic systems. U.S. Pat. No. 2,470,792, issued May 24, 1949 to Schlessinger et al., discloses noncorrosive hydraulic fluid compositions comprising a major amount of an alkyl phosphate ester, a liquid aliphatic ketone and up to 2 percent by weight of water. This patent does not teach the use of any type of soluble salt to control valve erosion.

U.S. Pat. No. 3,352,780, issued Nov. 14, 1987 to Groslambert et al., discloses the use of alkaline earth metal sulfonates, such as calcium sulfonate, as rust inhibitors in phosphate ester-based hydraulic fluids.

U.S. Pat. No. 3,411,923, issued Nov. 19, 1968 to Bretz, discloses a composition comprising (a) a metal-containing organic phosphate complex prepared by reaction of a polyvalent metal salt of an acid phosphate ester with an organic epoxide and (b) a basic alkali or alkaline earth metal salt of a sulfonic or carboxylic acid having at least about 12 aliphatic carbon atoms. This patent teaches that the disclosed composition can be used to inhibit corrosion of metal surfaces. In column 13, lines 55–70, it is also disclosed that these compositions may be useful in hydraulic oils, among other fluids.

U.S. Pat. No. 3,597,359, issued Aug. 3, 1971 to Smith, discloses a functional fluid composition consisting of a hydrocarbon phosphorus ester and a perfluoro alkylene ether compound. This patent teaches that the disclosed compositions inhibit and control damage to mechanical members when the composition is used as a hydraulic fluid.

U.S. Pat. No. 3,679,587, issued Jul. 25, 1972 to Smith, discloses phosphate ester-based functional fluid compositions containing small amounts of perfluorinated anionic surfactants. When employed as a hydraulic fluid, these compositions are taught to have an increased ability to inhibit erosion of the hydraulic system.

U.S. Pat. No. 3,707,501, issued Dec. 26, 1972 to Gentit, et al., discloses hydraulic fluid compositions containing a minor percentage of a quaternary phosphonium compound. This patent teaches that these quaternary phosphonium compounds inhibit damage to the metallic environment containing the hydraulic fluid.

U.S. Pat. No. 3,907,697, issued Sep. 23, 1975 to Burrous, discloses functional fluid compositions containing a small amount of a soluble salt of a perhalometallic or perhalometalloidic acid. The incorporation of the salt into the fluid base is taught to improve the anti-erosion properties of the functional fluid. U.S. Pat. No. 4,206,067, issued Jun. 3, 1980 to MacKinnon, teaches that the functional fluid composition described in U.S. Pat. No. 3,907,697 can be stabilized at elevated temperatures by addition of a high-boiling-point organic base to the fluid.

U.S. Pat. No. 4,252,662, issued Feb. 24, 1981 to Marolewski, et al., discloses a functional fluid composition comprising a minor percentage of an ammonium salt of a phosphorous acid in a phosphorus ester and/or amide-containing base stock. The functional fluid composition is taught to inhibit and control damage to mechanical members in contact with the fluid.

U.S. Pat. No. 4,302,346, issued Nov. 24, 1981 to MacKinnon, discloses a phosphate ester-based functional fluid composition comprising a major amount of a phosphate ester and a perfluorinated anionic surfactant selected from the group consisting of the di- and trivalent metal salts of a perfluoroalkane sulfonic acid or perfluoroalkane disulfonic acid. This patent teaches that the addition of a small amount to the metal salt to the functional fluid greatly enhances the anti-erosion properties of the fluid. Similarly, U.S. Pat. No. 4,324,674, issued Apr. 13, 1982 to MacKinnon, discloses a phosphate ester-based functional fluid containing the amine salts of the above acids and teaches that these salts similarly enhance the anti-erosion properties of the fluid.

Among the additives cited above, the salts of super acids, such as perfluoroalkane sulfonic acids, perfluoroalkane disulfonic acids, perhalometallic acids, and perhalometalloidic acids, have proven to be especially effective as streaming potential inhibitors for phosphate ester-based hydraulic fluids. These salts however are expensive and not widely available. More importantly, recent information suggests that current hydraulic fluids containing these additives are not able to withstand the high service temperatures found in some modern aircraft.

The engine-driven hydraulic pumps in some modern aircraft are mounted on the core of the jet engine. Fluid temperatures as high as 300° F. have been measured in these critical areas. Exposure of hydraulic fluid to these high temperatures has been found to reduce the effective life of the fluid. This high temperature instability is believe to be due to hydrolysis of the phosphate ester component. Epoxides are normally present in the hydraulic fluid to serve as hydrolysis inhibitors. However, at high operating temperatures in the presence of certain commercial streaming potential inhibitors, i.e. the salts of extremely strong acids, the epoxide is believed to be consumed in unproductive side reactions such as polymerization and etherification. Thus, excessive hydrolysis of the phosphate ester fluid occurs resulting in the need to frequently replace the hydraulic fluid. High material and labor costs make frequent replacement of aircraft hydraulic fluid economical undesirable. Therefore, a need exists for an effective streaming potential inhibitor which is compatible with the epoxide component of the hydraulic: fluid under the high operating temperatures found in some modern aircraft.

SUMMARY OF THE INVENTION

The present invention provides a functional fluid comprising a fluid base and an effective amount of a streaming potential-inhibiting metal salt. The functional fluid is particularly suitable for use in aircraft hydraulic systems and, when used in such systems, provides inhibition of erosion to the metal environment containing the functional fluid.

One aspect of the present invention provides a functional fluid comprising an effective amount of a soluble streaming potential-inhibiting metal salt; an epoxide; and a major amount of a phosphate ester; such that the metal salt is compatible with the epoxide component of the functional fluid at a temperature of about 260° F. and the functional fluid has a wall current of less than 0.15 microamperes.

Another aspect of the present invention provides an erosion-inhibited phosphate ester-based functional fluid comprising a major amount of a phosphate ester and from 10 to 50,000 parts per million by weight of a calcium salt of an organic sulfonate, the functional fluid having been heated to a temperature for a time sufficient to increase the conductivity of the fluid to at least 0.3 $\mu$ mho/cm.

DETAILED DESCRIPTION OF THE INVENTION

It has now been discovered that certain metal salts inhibit the formation of streaming potential in epoxide-containing phosphate ester-based hydraulic fluids. In one embodiment, it has been further discovered that the calcium salts of organic sulfonates inhibit the formation of streaming potential in phosphate ester hydraulic fluids, provided that the ester-sulfonate mixture is heated before use as a hydraulic fluid. Among other things, this invention is based on the discovery that these streaming potential-inhibiting metal salts are compatible with the epoxide component of the functional fluid at elevated temperatures.

The Streaming Potential Inhibitor

The streaming potential inhibitors useful in the present invention are metal salts. As used herein, the term "metal salt" refers to an ionic compound comprising a metal cation and an organic or inorganic anion.

Metal cations useful in the present invention include cations of alkaline earth metals and certain transition metals. Representative alkaline earth metals include barium, calcium, and magnesium. Representative transition metals include cadmium, cobalt, copper, gold, iron, manganese, nickel, tin, titanium, zinc, and zirconium. The preferred metal cations for use in this invention are selected from the group consisting of cadmium, calcium and zinc. Especially preferred metal cations are those of calcium and zinc.

Cations specifically excluded from this invention are non-metallic cations such as ammonium and phosphonium cations.

Anions that are useful in this invention can be either organic or inorganic.

As described further hereinbelow, the salts of extremely strong acids, such as perfluoroalkane sulfonic acids and perhalometallic acids, have been found to be incompatible with the epoxide component of the functional fluid at elevated temperatures. Generally, an anion useful in the present invention has a conjugate acid which is less acidic than these strong acids. In general, a useful anion will have conjugate acid which has a $pK_a$ greater than or equal to $-10$ (relative to water), preferably the conjugate acid of the anion will have a $pK_a$ greater than or equal to $-7$ (relative to water). The $pK_a$ of strong acids, especially acids which have a $pK_a$ below $-2$, can only be determined approximately. Thus, frequently only the relative acidity of two acids can be easily determined. Generally, the conjugate acid of an anion useful in the present invention will not be more acidic than hydriodic acid (HI). Preferably, the conjugate acid of a useful anion will not be more acidic than hydrochloric acid (HCl). The $pK_a$ valves for a number of acids can be found in March, *Advanced Organic Chemistry,* Second Edition, McGraw-Hill Book Co., New York, 1977, pp. 225-245, which is hereby incorporated by reference.

Useful inorganic anions include halogens, such as chloride, bromide, and iodide; oxygen-containing anions of the Group V and Group VI elements, such as nitrate, phosphate and sulfate; and other inorganic anions, such as borate and tetrafluoroborate. Preferred inorganic anions are chloride and nitrate.

Organic anions useful in this invention include sulfonates; phosphate mono- and diesters; phosphonates and phosphonate monoesters; and carboxylic acids.

Useful sulfonate anions include those that are frequently used in aqueous detergents, such as olefin sulfonates, alkylaryl sulfonates, paraffin sulfonates, and similar compounds. The alkylaryl sulfonates are the preferred sulfonate anions for use in this invention. The alkylaryl sulfonates may be made by sulfonating natural mixtures of aromatic compounds such as crude oil, naphtha, etc., or they may be made synthetically by sulfonating the reaction product of an olefin, alkyl halide, or alkanol with an aromatic compound. These sulfonates have alkyl groups of 8 to 28 carbons attached to aryl groups such as benzene, toluene, naphthalene, and the like. The preferred sulfonate anion is dinonylnaphthalenesulfonate. The calcium salt of this compound is commercially available from Vanderbilt as Nasul 729.

Useful phosphate ester anions include mono- and dialkyl phosphates; mono- and diaryl phosphates; and mixed alkyl aryl phosphates. As used herein, the term "alkyl" includes aliphatic and alicyclic hydrocarbons and the term "aryl" includes aryl, alkaryl, and aralkyl hydrocarbons. The two hydrocarbon groups of the dialkyl or diaryl phosphates may be the same or different.

The phosphate ester anions will each have a total carbon content of 2 to about 24 carbon atoms. Individual alkyl groups will usually have 1 to about 12 carbon atoms, while individual aryl groups will usually have 6 to about 12 carbon atoms. The alkyl groups may be straight- or branched-chain. Similarly, the alkyl substituents in alkylaryl structures may also be straight- or branched-chain. Examples of useful phosphate diester anions include dimethyl phosphate, di-n-butyl phosphate, n-butyl n-octyl phosphate, dicyclohexyl phosphate, diphenyl phosphate, cresyl phenyl phosphate, ethyl phenyl phosphate, isopropyl phenyl phosphate, diisopropyl phosphate and dicresyl phosphate. Examples of useful phosphate monoester anions include methyl phosphate, ethyl phosphate, isopropyl phosphate, n-butyl phosphate, n-octyl phosphate, cyclohexyl phosphate, phenyl phosphate, and cresyl phosphate.

The phosphate ester anions are either commercially available as salts or the free acid; or can be prepared by methods well known in the chemical literature; for example, by either acid- or base-catalyzed hydrolysis of phosphate triesters as described in Streitwieser and Heathcock, *Introduction to Organic Chemistry,* Macmillan Publishing Co., New York, 1976, pp. 501-505, which is hereby incorporated by reference.

Useful phosphonate anions include alkylphosphonates, arylphosphonates, monoalkyl alkylphosphonates, monoaryl alkylphosphonates, monoalkyl arylphosphonates, and monoaryl arylphosphonates, where the terms "alkyl" and "aryl" are as defined hereinabove.

Generally, individual alkyl groups of the phosphonate anions will have 1 to about 12 carbon atoms, while individual aryl groups will have 6 to about 12 carbon atoms. The alkyl groups may be straight- or branched-chain. Similarly, the alkyl substituents in alkylaryl structures may also be straight- or branched-chain. The two hydrocarbon groups of the monoalkyl alkylphosphonates and monoaryl arylphosphonates may be the same or different. Examples of useful phosphonates include methylphosphonate, ethylphosphonate, isopropylphosphonate, n-butylphosphonate, cyclopentylphosphonate, and phenylphosphonate. Examples of useful phosphonate monoesters include methyl methylphosphonate, methyl n-butylphosphonate, ethyl cyclohexylphosphonate, phenyl ethylphosphonate and phenyl phenylphosphonate.

The phosphonate anions are either commercially available as salts or the free acid; or can be prepared by methods well known in the chemical literature, such as by alkaline hydrolysis of the phosphonate diesters as described in Streitwieser and Heathcock, *Introduction to Organic Chemistry,* Macmillan Publishing Co., New York, 1976, pp. 501-505.

Useful carboxylic acid anions include alkyl and aryl carboxylates, where the terms "alkyl" and "aryl" are as defined hereinabove.

Generally, individual alkyl groups of the carboxylate anions will have 1 to about 20 carbon atoms, while individual aryl groups will have 6 to about 12 carbon atoms. The alkyl groups may be straight- or branched-chain. Similarly, the alkyl substituents in alkylaryl structures may also be straight- or branched-chain. Optionally, the alkyl or aryl groups of the carboxylate anions may be halogenated, i.e. containing, for example, fluoro- and chloro-substituents. Examples of useful carboxylate anions include acetate, benzoate, 2-ethylhexanoate, stearate and trifluoroacetate.

The carboxylate anions are either commercially available as salts or the free acid; or can be prepared by methods well known in the chemical literature, as described for example in Streitwieser and Heathcock, *Introduction to Organic Chemistry,* Macmillan Publishing Co., New York, 1976, pp. 423-446, which is hereby incorporated by reference.

Metal salts useful in the present invention are combinations of a streaming potential-inhibiting metal cation as defined hereinabove and an anion as described hereinabove such that the metal salt resulting from this combination is soluble in the phosphate ester-based functional fluid in an erosion-inhibiting amount.

Preferred streaming potential-inhibiting metal salts are selected from the group consisting of cadmium chloride, cadmium nitrate, calcium dinonylnaphthalenesulfonate, cobalt(II) chloride, copper(II) chloride, iron(II) chloride, magnesium chloride, manganese(II) chloride, nickel(II) chloride, tin(II) chloride, tin(II) 2-ethylhexanoate, zinc chloride, zinc trifluoroacetate and zirconium chloride. More preferred salts are cadmium chloride, calcium dinonylnaphthalenesulfonate and zinc chloride. Especially preferred is zinc chloride.

Other useful streaming potential-inhibiting metal salts are barium acetate, barium chloride, barium diphenyl phosphate, barium methyl methylphosphonate, barium nitrate, barium sulfate, barium trifluoroacetate, cadmium acetate, cadmium benzoate, cadmium bromide, cadmium n-butyl phosphate, cadmium n-butylphosphonate, cadmium dimethyl phosphate, cadmium dinonylnaphthalenesulfonate, cadmium 2-ethylhexanoate, cadmium methyl n-butylphosphonate, cadmium phenylphosphonate, cadmium phosphate, cadmium stearate, cadmium sulfate, cadmium tetrafluoroborate, cadmium trifluoroacetate, calcium acetate, calcium benzoate, calcium borate, calcium bromide, calcium chloride, calcium di-n-butyl phosphate, calcium 2-ethylhexanoate, calcium methyl methylphosphonate, calcium nitrate, calcium;: phenyl phosphate, calcium phenyl phenylphosphonate, calcium phosphate, calcium stearate, calcium stearate, calcium sulfate, calcium tetrafluoroborate, calcium trifluoroacetate, cobalt(II) acetate, cobalt(II) 2-ethylhexanoate, cobalt(II) nitrate, cobalt(II) dimethyl phosphate, copper(II) acetate, copper(II) 2-ethylhexanoate, copper(II) nitrate, copper(II) phosphate, copper(II) sulfate, gold(III) chloride, iron(II) acetate, iron(II) 2-ethylhexanoate, iron(II) nitrate, iron(II) phosphate, iron(II) sulfate, iron(II) tetrafluoroborate, magnesium acetate, magnesium di-n-butyl phosphate, magnesium nitrate, magnesium phosphate, magnesium sulfate, manganese(II) acetate, manganese(II) nitrate, manganese(II) phosphate, manganese(II) sulfate, nickel(II) acetate, nickel(II) nitrate, nickel(II) sulfate, nickel(II) tetrafluoroborate, tin(II) acetate, tin(II) 2-ethylhexanoate, tin(II) nitrate, tin(II) sulfate, tin(II) tetrafluoroborate, titanium chloride, zinc acetate, zinc benzoate, zinc bromide, zinc n-butyl phosphate, zinc dimethyl phosphate, zinc dinonylnaphthalenesulfonate, zinc 2-ethylhexanoate, zinc methyl phenylphosphonate, zinc nitrate, zinc phenylphosphonate, zinc phosphate, zinc stearate, zinc sulfate, zinc tetrafluoroborate, zirconium acetate and zirconium sulfate.

Many of the streaming potential-inhibiting metal salts useful in this invention are commercially available. Methods for preparing the various metal salts are also well known in the chemical literature. For example, many of the metal salts containing organic anions can be prepared by reaction of the organic acid, such as a carboxylic acid, sulfonic acid, or phosphoric or phosphonic acid, with a metal base, such as a metal oxide, hydroxide or carbonate.

Generally, when used in this invention, the metal salts will have a purity of at least 98 percent by weight. Salts of lower purity may be used, but are generally not preferred, except, for example, where an economic advantage is achieved by using a less pure material. The metal salts may be in either an anhydrous or hydrated form when used in this invention.

The concentration of metal salt used in the functional fluid to inhibit streaming potential varies depending on the salt selected, the composition of the functional fluid, the fluid operating temperature, etc. To be useful in the present invention, the metal salt must be soluble in the functional fluid in which it is used in an amount sufficient to provide satisfactory inhibition of streaming potential, i.e. the resulting functional fluid will have a wall current of less than 0.15 microamperes, preferable less than 0.10 microamperes. Generally, the metal salt will be incorporated into the functional fluid in an amount ranging from 5 to 5000 parts per million by weight of the functional fluid. Preferably, the functional fluid contains at least 20 parts per million and more preferably, 40 to 2000 parts per million of the metal salt. Amounts greater than 5000 parts per million can be employed if soluble in the fluid, however, no commensurate advantages are obtained thereby.

Heating of the Mixture

It has been found that heating of the metal salt in the fluid base mixture is required in some cases to produce a functional fluid having good streaming potential inhibition. It is believed that heating is required to aid in the initial ionization of the metal salt. When a calcium sulfonate is used as a streaming potential inhibitor in a phosphate ester-based fluid, heating is essential for the production of a mixture exhibiting acceptable streaming potential inhibition. The heating is done at a temperature and for a time sufficient to increase the conductivity of the fluid to at least 0.3 $\mu$ mho/cm. Generally, when required, the heating must be in excess of 140° F. and in the range of 140° F. to 250° F., and more preferably from 180° F. to 225° F. Generally the heating should be continued for 1 to 20 hours, preferably for 2 to 4 hours to obtain the increase in conductivity to 0.3 $\mu$ mho/cm. The preferred mode of operation is to heat the mixture for 3 hours at 225° F. Heating for long times at low temperatures is generally not practical.

The Fluid Base

The power transmission fluid of the present invention comprises a fluid base present in major proportion in which the streaming potential inhibitors of the present invention are contained. The fluid base employed in this invention can be composed of a variety of base materials, such as organic esters of phosphorus acids, mineral oils, synthetic hydrocarbon oils, silicate esters, silicones, carboxylic acid esters, aromatic hydrocarbons and aromatic halides, esters of polyhydric material, aromatic ethers, thioethers, etc.

Phosphate esters are the preferred base fluid for use in the present invention. Typical phosphate esters useful in this invention have the formula:

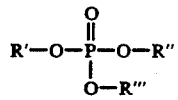

wherein R', R'' and R''' each represent an alkyl or aryl hydrocarbon group. As described hereinabove, the term "aryl" includes aryl, alkaryl, and aralkyl structures and the term "alkyl" includes aliphatic and alicyclic structures. All three hydrocarbon groups may be the same, or all three different, or two of the hydrocarbon groups may be alike and the third different. A typical fluid useful in the present invention will contain at least one species of phosphate ester and usually will be a mixture of two or more species of phosphate esters.

The phosphate esters will each have a total carbon content of 3 to 36 carbon atoms. Individual alkyl group will usually have 1 to 12 carbon atoms, while individual aryl groups will usually have 6 to 12 carbon atoms. Preferred phosphate esters contain 12 to 24 total carbon atoms. Preferred alkyl groups contain 4 to 6 carbon atoms, while preferred aryl groups contain 6 to 9 carbon atoms. The alkyl groups may be straight- or branched-chain, with straight-chain, such as n-butyl, preferred. Similarly, the alkyl substituents in alkylaryl structures may also be straight- or branched-chain, with methyl or isopropyl preferred. Generic examples of the phosphate esters include trialkyl phosphates, triaryl phosphates and mixed alkyl aryl phosphates. Specific examples include trimethyl phosphate, tributyl phosphate, dibutyl octyl phosphate, triphenyl phosphate, phenyl dicresyl phosphate, ethyl diphenyl phosphate, isopropyl diphenyl phosphate, diisopropyl phenyl phosphate, dibutyl phenyl phosphate, tricresyl phosphate, triisopropylphenyl phosphate, etc.

In practice, a phosphate ester-based fluid generally contains several phosphate esters mixed together. Usually, one particular ester or several closely related esters will predominate. In a preferred type of fluid, the phosphate ester portion contains only trialkyl and triaryl phosphate esters, with the trialkyl phosphate esters predominating.

In the functional fluid of the present invention, the phosphate ester will be present in a major amount. By the term "major amount" it is meant that the weight percent of phosphate ester exceeds the weight percent on any other individual component of the functional fluid. Typically, the phosphate ester portion of this fluid will consist of 70 to 99 weight percent, preferably, 80 to 92 weight percent trialkyl phosphate esters, with the remainder triaryl phosphate esters. The phosphate ester portion is normally 75 to 95 weight percent of the total fluid and preferably 85 to 95 weight percent.

The Epoxide

Epoxides are an essential component of phosphate ester-based hydraulic fluids. Epoxides are necessary to prevent or reduce the hydrolysis of the phosphate ester base fluid. Typical epoxide compounds which may be used include glycidyl methyl ether, glycidyl isopropyl ether, styrene oxide, ethylene oxide, and epichlorohydrin. A preferred class of epoxide hydrolysis inhibitors are those containing two linked cyclohexane groups to each of which is fused an epoxide (oxirane) group. Particularly preferred diepoxides have the following generalized structure:

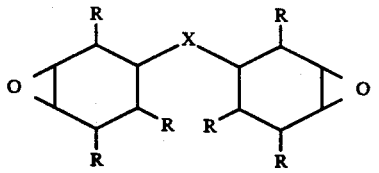

where X is a divalent organic radical containing 1 to 10 carbon atoms, from 0 to 6 oxygen atoms and from 0 to 6 nitrogen atoms; and each R is the same or different and is selected from the group consisting of hydrogen and lower aliphatic radicals. As defined herein, the term "lower aliphatic" refers to aliphatic groups containing 1 to 5 carbon atoms. In a preferred embodiment, R is hydrogen. In another preferred embodiment, two of the six R groups are methyl radicals and the other four are hydrogen.

Preferably, the X linking group is a divalent organic radical of a carboxylate group, a dioxane group, an amine group, an amide group or an alkoxy group, or combinations thereof. More preferably the linking structure contains a carboxylate group or a dioxane group. Representative examples of such compounds include 2-(3,4-epoxycyclohexyl-5,5-spiro-3,4-epoxy)cyclohexane-meta-dioxane, (marketed by Union Carbide under the brand name ERL-4234), 3,4-epoxycyclohexylmethyl-3,4-epoxycyclohexane carboxylate, (marketed by Union Carbide under the brand name ERL-4221), and bis(3,4-epoxycyclohexyl) adipate, (marketed by Union Carbide under the brand name ERL-4299).

In order to serve their inhibitory function, the epoxide groups should preferably be present in a minor but significant amount. This amount is essentially independent of the structure of the epoxide compound and may conveniently be expressed as "oxirane oxygen content" of the total fluid composition. Oxirane oxygen content is defined as: [(Moles of Epoxide Compound)×(Number of Epoxide Groups)×(Atomic Weight of Oxygen)/Weight of the Total Composition]×100=Oxirane Oxygen Content as a weight percent of the total functional fluid composition. Oxirane oxygen content is conveniently measured by titrating the fluid using the procedures described in ASTM D2896 as described further hereinbelow. Oxirane oxygen content should be in the range of from about 0.05 to about 1.5 percent by weight of the total composition, preferably in the range of from about 0.2 to about 0.6 percent by weight.

Other Additives

The power transmission fluids of the present invention generally contain a number of additives which in total comprise 5 to 25 weight percent of the finished fluid. Among these is water, which may be added or often becomes incorporated into the fluid unintentionally. Such incorporation can occur when a hydraulic system is being refilled and is open to the atmosphere, particularly in humid environments. Unintentional incorporation of water may also occur during the manufacturing process of a phosphate fluid. In practice, it is recognized that water will be incorporated into the fluid and steps are taken to control the water content at a level in the range of 0.1 to 1 weight percent of the whole fluid. It is preferred that the water content be in the range of 0.1 to 0.8 weight percent and more preferably, 0.15 to 0.30 weight percent.

Hydrocarbon sulfides, especially hydrocarbon disulfides, such as dialkyl disulfide, are often used in combination with the epoxide compounds for additional corrosion suppression. Typical hydrocarbon disulfides include benzyl disulfide, butyl disulfide and diisoamyl disulfide.

The hydraulic fluid normally contains 2 to 10 weight percent, preferably 5 to 10 weight percent, of one or more viscosity index improving agents such as alkyl styrene polymers, polymerized organic silicones, or preferably, polyisobutylene, or the polymerized alkyl esters of the acrylic acid series, particularly acrylic and methacrylic acid esters. These polymeric materials generally have a number average molecular weight of from about 2,000 to 300,000.

Compatibility of Components

It is critical that the soluble streaming potential-inhibiting metal salts of the present invention be compatible with the epoxide component of the functional fluid in which they are utilized. In general, the components of a phosphate ester-based functional fluid are considered compatible if, when heated at about 260° F. in the presence of copper and steel coupons, the acid number of the fluid does not exceed 1.5 milligrams of potassium hydroxide per gram of fluid after 168 hours, or the oxirane oxygen content of the fluid does not decrease by more than 50 percent after 96 hours.

As described hereinabove, epoxides are commonly used in phosphate ester-based hydraulic fluids to inhibit hydrolysis of the phosphate ester fluid base. It is believed that water present in the hydraulic fluid slowly reacts with the phosphate esters to form an alcohol and an acidic dialkyl- or diaryl phosphate ester. This acidic component then catalyzes the hydrolysis of additional phosphate esters and decomposition of the fluid is accelerated. The epoxide acts as an acid acceptor and reacts with the acidic dialkyl- or diaryl phosphate ester, thus halting the catalytically accelerated hydrolysis of the phosphate ester base fluid.

Some commercial streaming potential inhibitors, such as the salts of superacids including, for example, salts of perfluoroalkane sulfonic acids, perfluoroalkane disulfonic acids, perhalometallic acids, and perhalometalloidic acids, have been found to promote the decomposition of the epoxide component in hydraulic fluid, especially at high fluid temperatures. It is believe that the salts: of extremely strong acids promote unproductive side reactions of the epoxide such as polymerization and etherification, thus consuming a large amount of the epoxide normally available for inhibition of phosphate ester hydrolysis. Thus, hydrolysis of the phosphate ester fluid is free to occur at an accelerated rate, thereby shortening the effective life of the hydraulic fluid.

Surprisingly, the metal salts of the present invention effectively inhibit streaming potential in phosphate ester-based hydraulic fluid and are compatible with the epoxide component of the fluid at elevated temperatures.

The rate of hydrolysis of the phosphate ester fluid base can be determined by measuring the acid number of the fluid at various time intervals. The acid number of the fluid increases as the phosphate esters are hydrolyzed. In general, an acid number that does not exceed 1.5 milligrams of potassium hydroxide per gram of fluid when the fluid has been heated for 168 hours at about 260° F. in the presence of copper and steel coupons is satisfactory. Preferably, the acid number of the fluid does not exceed 1.5 mg KOH/g when heated for 240 hours at about 260° F., more preferably the acid number does not exceed 1.5 mg KOH/g when the fluid is heated for 14 days (330 hours) at about 260° F.

Similarly, the rate of epoxide consumption can be measured by determining the amount of epoxide (oxirane) functionality present in the fluid at various time intervals. In general, compatibility of the functional fluid components is satisfactory if the oxirane oxygen content of the fluid does not decrease by more than 50 percent when the fluid has been heated for 96 hours at 260° F. in the presence of copper and steel coupons. Preferably, the oxirane oxygen content of the functional fluid does not decrease by more than 40 percent when the fluid has been heated for 96 hours at 260° F. and more preferably, the oxirane oxygen content does not decrease by more than 20 percent when the fluid has been heated for 96 hours at 260° F.

These tests therefore provide a method for determining the compatibility of the components of the hydraulic fluid. Procedures for these tests are described in further detail hereinbelow.

Measurements

It has been found that the rate of valve erosion in aircraft hydraulic system valves varies with the electrical streaming potential of the hydraulic fluid passing through the valve. As indicated hereinabove, streaming potential is the electromotive force (EMF) created when a liquid is forced by pressure through an orifice and is a function of various factors such as the electrical properties and viscosity of the liquid, the applied pressure, and the physical characteristics of the orifice. Since the streaming potential is dependent on several factors, it is found that the streaming potential measurement of a given fluid on a given apparatus at a given time will vary over a small range. For this reason, the ordinary practice is to select as a standard a fluid which is considered to have acceptable erosive characteristics. Each day the apparatus is calibrated by measuring the streaming potential of the standard fluid and then comparing the streaming potential of the test fluids against this standard. The apparatus used to measure streaming potential is described in detail in Beck et al., "Wear of Small Orifices by Streaming Current Driven Corrosion", Transactions of the ASME, Journal of Basic Engineering, pages 782–791 (December, 1970). Measurements are taken at room temperature with the fluid pressure adjusted to 800 psi. For convenience, the streaming potential detected by the apparatus is impressed across a standard 100,000-ohm resistor to obtain a resultant current, which is reported as the "streaming current" or "wall current".

The advantages of the present invention will be readily apparent from consideration of the following examples. These examples are provided for the purposes of illustration and comparison only and should not be interpreted as limiting the scope of the present invention.

EXAMPLES

Cadmium Chloride as a Streaming Potential Inhibitor

To 1.00 gram of cadmium chloride hemipentahydrate (FW 228.34) was added sufficient water to produce a 10.00 gram solution. This solution was then diluted with 100.0 grams of methanol and 10.0 grams of the resulting solution added to 300.0 grams of tributylphosphate. This solution was then stripped under vacuum to give a 303 ppm solution of cadmium chloride hemipentahydrate or 149 ppm cadmium (1.33 mm/kg). From this solution, blends containing various amounts of cadmium were prepared and tested in the wall current apparatus as described hereinabove. The data for these tests are shown in Table 1.

TABLE 1

Streaming Potential and Wall Current of Tributylphosphate Solutions Containing Cadmium Chloride

| Example | Cadmium Conc.[1] ppm | Cadmium Conc.[1] mm/kg | Streaming Potential[2] | Wall Current[3] |
|---|---|---|---|---|
| 101 | 0 | 0 | 57.0 | 0.570 |
| 102 | 9.94 | 0.088 | 11 | 0.11 |
| 103 | 14.7 | 0.131 | 7 | 0.07 |
| 104 | 33.8 | 0.300 | 3 | 0.03 |
| 105 | 70.4 | 0.626 | 2 | 0.02 |
| 106 | 117.1 | 1.041 | 1 | 0.01 |

[1]Concentration of cadmium in tributylphosphate.
[2]In millivolts.
[3]In microamperes.

Cadmium Nitrate as a Streaming Potential Inhibitor

Cadmium nitrate tetrahydrate (FW 308.47) was dissolved in water to produce a 10 percent solution by weight. This solution was then added as needed to tributylphosphate to prepare solutions containing various concentrations of cadmium. These solutions were then stripped under vacuum and filtered and tested in the wall current apparatus as described hereinabove. The data for these tests are shown in Table 2.

TABLE 2

Streaming Potential and Wall Current of Tributylphosphate Solutions Containing Cadmium Nitrate

| Example | Cadmium Conc.[1] ppm | Cadmium Conc.[1] mm/kg | Streaming Potential[2] | Wall Current[3] |
|---|---|---|---|---|
| 201 | 0 | 0 | 53.0 | 0.530 |
| 202 | 28 | 0.25 | 21 | 0.21 |
| 203 | 52 | 0.46 | 12 | 0.12 |
| 204 | 68 | 0.60 | 8–10[4] | 0.08–0.10[4] |

[1]Concentration of cadmium in tributylphosphate.
[2]In millivolts.
[3]In microamperes.
[4]Streaming potential and wall current were variable.

The data in Tables 1 and 2 demonstrate the reduction in the streaming potential of tributylphosphate solutions containing either cadmium chloride or cadmium nitrate at various concentrations. In general, wall currents of less than 0.15 microamperes are considered satisfactory with wall currents less than 0.10 microamperes being preferred. In Table 1, Example 101 shows that tributylphosphate, containing no cadmium chloride, has a wall current of 0.57 microamperes. Examples 102–106 in Table 1 show that addition of cadmium chloride to tributylphosphate to form solutions containing from 9.94 to 117.1 ppx: of cadmium reduced the wall current of the resulting solution to a satisfactory level. Similarly, Examples 203 and 204 of Table 2 show that addition of cadmium nitrate to tributylphosphate to form solutions containing 52 and 68 ppm of cadmium, respectively, reduced the wall current of these solutions to a satisfactory level. Example 202, which contained 28 ppm of cadmium, significantly reduced the wall current of the solution, but not to a satisfactory level.

Reduction of Wall Current Using Metal Salts

Using procedures similar to those described for cadmium chloride and cadmium nitrate hereinabove, tributylphosphate solutions containing 50 ppm of various metal salts were prepared and tested in the wall current apparatus. The data for these tests are shown in Table 3.

TABLE 3

Wall Current of Tributylphosphate Solutions Containing Various Metal salts at 50 ppm

| Ex. | Metal Salt | Wall Current[1] | Comments |
|---|---|---|---|
| 301 | None | +0.45 to +0.60 | |
| 302 | Aluminum Chloride | +0.65 | |
| 303 | Aluminum Isopropoxide | +0.40 | Hazy.[2] |
| 304 | Aluminum Phosphate | +0.40 | |
| 305 | Barium Chloride | +0.50 | |
| 306 | Barium Nitrate | +0.41 | |
| 307 | Barium Sulfate | — | Insoluble.[3] |
| 308 | Cadmium Acetate | +0.47 | |
| 309 | Cadmium Chloride | +0.01 to +0.07 | |
| 310 | Calcium Chloride | — | Insoluble.[3] |
| 311 | Cobalt(II) Chloride | +0.04 | |
| 312 | Copper(II) Chloride | +0.01 | |
| 313 | Gold(III) Chlordie | −0.04 | Precipitated.[4] |
| 314 | Iron(II) Chloride | −0.02 | Precipitated.[4] |

TABLE 3-continued

Wall Current of Tributylphosphate Solutions Containing Various Metal salts at 50 ppm

| Ex. | Metal Salt | Wall Current[1] | Comments |
|---|---|---|---|
| 315 | Iron(II) Sulfate | — | Insoluble.[3] |
| 316 | Magnesium Chloride | +0.11 | |
| 317 | Magnesium Sulfate | — | Hazy.[2] |
| 318 | Manganese(II) Chloride | +0.08 | |
| 319 | Nickel(II) Chloride | +0.05 | |
| 320 | Palladium(II) Chloride | +0.36 | |
| 321 | Potassium Chloride | +0.57 | At 200 ppm. |
| 322 | Silver Chloride | +0.30 | |
| 323 | Silver Nitrate | +0.23 | |
| 324 | Silver Trifluoroacetate | +0.23 | |
| 325 | Sodium Chloride | +0.63 | At 200 ppm. |
| 326 | Tin(II) Chloride | −0.05 | Hazy.[2] |
| 327 | Tin(II) 2-Ethylhexanoate | +0.09 | Hazy.[2] |
| 328 | Zinc Acetate | +0.31 | |
| 329 | Zinc Chloride | +0.01 | |
| 330 | Zinc Isopropoxide | +0.20 | Precipitated.[4] |
| 331 | Zinc Sulfate | +0.40 | Hazy.[2] |
| 332 | Zinc Trifluoroacetate | +0.06 | |

[1]In microamperes.
[2]Solution was hazy after mixing or on standing.
[3]Metal salt was insoluble.
[4]Metal salt precipitated from solution on standing.

The data in Table 3 demonstrates that cadmium chloride, cobalt(II) chloride, copper(II) chloride, magnesium chloride, manganese(II) chloride, nickel(II) chloride, zinc chloride and zinc trifluoroacetate reduce the wall current of a tributylphosphate solution to a satisfactory level, i.e. less than 0.15 microamperes, and are soluble in tributylphosphate when used at a concentration of 50 ppm.

Epoxide Stability

Epoxide (oxirane) stability was measured by preparing ampules containing a streaming potential inhibitor and 0.44 weight percent water in 15 milliliters of a fully formulated hydraulic fluid. The initial concentration of oxirane oxygen in each ampule was 0.24 weight percent. The ampules were heated at 260° F. in the presence of copper and steel coupons for various periods of time. The acid number and weight percent oxirane oxygen were then measured.

The acid number of the ampule solution was measured after heating the ampule at 260° F. for 168 hours. Acid numbers were determined using the procedure described in ASTM D974. The streaming potential inhibitor was considered compatible with the epoxide component if the acid number of the fluid did not exceed 1.5 milligrams of potassium hydroxide (KOH) per gram of fluid.

The oxirane concentration was determined by measuring the percent oxirane oxygen in each solution. The amount of oxirane oxygen was measured by titrating each solution with perchloric acid in the presence of hexadecyltrimethylammonium bromide as described in ASTM D2896. The initial weight percent oxirane oxygen in each ampule was 0.24. The ampules were then heated at 260° F. for 96 hours. The streaming potential inhibitor was considered compatible with the epoxide if the resulting solution contained at least 0.12 weight percent oxirane oxygen, i.e. the oxirane oxygen content did not decrease by more than 50 percent.

Using the above procedures, the stability of the epoxide component was determined in the presence of several metal salts. The data for these tests are shown in Table 4.

TABLE 4

Epoxide Stability in the Presence of Metal Salts

| Ex. | Metal Salt | Conc. (mm/kg) | Wall Current[1] | Epoxide Stability Acid No.[2] | Epoxide Stability Oxirane %[3] |
|---|---|---|---|---|---|
| 401 | $CdCl_2$ | 0.5 | 0.02 | 0.12 | 0.22 (08%)[4] |
| 402 | Ca Sulfonate[5] | 2.5 | 0.09 | 0.16 | 0.20 (17%)[4] |
| 403 | Li Sulfonate[5] | 2.5 | 0.05 | 0.75 | 0.06 (75%)[4] |

[1]In microamperes.
[2]In milligrams KOH/g fluid, after 168 hours at 260° F.
[3]Oxirane oxygen weight percent after 96 hours at 260° F.
[4]Percent decrease in oxirane oxygen content.
[5]Anion is dinonylnaphthalenesulfonate.

The data in Table 4 illustrates that cadmium chloride (Example 401) and calcium dinonylnaphthalenesulfonate (Example 402) are compatible with the epoxide component of this fully formulated hydraulic fluid. This is evidenced by the fluids which contain these metal salts having an acid number which did not exceed 1.5 mg KOH/g of fluid after 168 hours at 260° F. or an oxirane oxygen content which did not decrease by more than 50 percent after 96 hours at 260° F. In addition, these fluids have an acceptable wall current (less than 0.15 microamperes). Lithium dinonylnaphthalenesulfonate (Example 403) is not compatible with the epoxide component as evidenced by a decrease in oxirane oxygen content of greater than 50 percent after 96 hours at 260° F. and an acid number which exceeds 1.5 mg KOH/g of fluid after 168 hours at 260° F.

Using procedures similar to those described hereinabove, epoxide stability was measured for fully formulated hydraulic fluids containing known streaming potential inhibitors which are salts of super acids. The stability of the epoxide component in these fluids was compared to similar fully formulated hydraulic fluids containing either cadmium chloride or no streaming potential inhibitor. Epoxide stability was determined by measuring epoxide loss per 100 hours at 260° F. for each fluid. The data for these tests are shown in Table 5.

TABLE 5

Epoxide Stability in the Presence of Salts of Super Acids

| Ex. | Epoxide | Inhibitor | Inhibitor Conc. (mm/kg) | Epoxide Loss[1] |
|---|---|---|---|---|
| 501 | ERL-4234[2] | None | — | 13 |
| 502 | ERL-4234 | $CdCl_2$ | 0.44 | 13 |
| 503 | ERL-4234 | $NH_4PF_6$ | 0.6 | 138 |
| 504 | ERL-4234 | Triflate[3] | 0.5 | 69 |
| 505 | ERL-4234 | PFOS[4] | 0.5 | 78 |

[1]Milliequivalents per kilogram per 100 hours.
[2]2-(3,4-Epoxycyclohexyl-5,5-spiro-3,4-epoxy)cyclohexane-meta-dioxane.
[3]Trioctylammonium trifluoromethanesufonic acid.
[4]Potassium perfluorooctanesulfonate.

The data in Table 5 illustrates that cadmium chloride (Example 502) caused no additional epoxide loss compared to the fluid containing no streaming potential inhibitor (Example 501). In contrast, epoxide loss was significant in each of the fluids containing streaming potential inhibitors which are salts of super acids (Examples 503, 504 and 505).

Calcium Sulfonate as a Streaming Potential Inhibitor

The following examples illustrate the effectiveness of calcium sulfonate additives in controlling the conductivity and wall current of a functional fluid. Conductivities in excess of $0.3\times10^{-6}$ mho/cm are considered satisfactory with conductivities in the range of 0.3 to $1.3\times10^{-6}$ mho/cm being preferred. Wall currents of less than 0.15 microamperes are considered satisfactory with wall currents less than 0.10 microamperes being preferred. The hydraulic fluid used in the following examples is the Society of Automotive Engineers (SAE) reference phosphate fluid SAE-1 (manufactured by Monsanto). This fluid is known to cause damage in servo valves. The calcium sulfonate additive is calcium dinonylnaphthalenesulfonate which was purchased from R. T. Vanderbilt Company, Inc., 230 Park Avenue, New York, N.Y. (Trade name Nasul 729).

In Example 601, about one liter of SAE-1 phosphate ester reference fluid was filter through a 1 micro millipore and the conductivity and wall current were measured. In Example 602, 10.00 grams of Nasul 727 (1.00%) was added to 990.00 grams of SAE-1 phosphate ester reference fluid and stirred at room temperature until dissolved. This solution was filtered through a 1 micro millipore and the conductivity was measured.

For Example 603, the solution of Example 602 was placed in a stoppered flask which was then stored in an oven at 225° F. ±4° F. for 3.0 hours. The solution was then cooled to room temperature yielding a clear bright solution. The conductivity and wall current were measured. The results are shown in Table 6.

Comparison of Examples 601, 602 and 603 indicates that surprisingly the conductivity of the test fluid was dramatically increased to a satisfactory level by heating the fluid.

TABLE 6

| Ex. | Sulfonate Additive | Concentration Wt. % | Heating of the Mixture Temperature, °F. | Heating of the Mixture Time | Conductivity (mho/cm)10-$^{-6}$ | Wall Curr. amps($10^{-6}$) |
|---|---|---|---|---|---|---|
| 601 | — | None | None | — | 0.02 | 0.36 |
| 602 | Nasul 729[1] | 1.00 | Room Temperature | — | 0.21 | — |
| 603 | Nasul 729[1] | 1.00 | 225° F. ± 4° F. | 3.0 hrs. | 0.51 | 0.13 |

[1]Calcium dinonylnaphthalenesulfonate.

What is claimed is:

1. A functional fluid comprising:

(a) 5 to 5000 parts per million of a soluble streaming potential-inhibiting metal salt having a cation selected from the group consisting of barium, cadmium, calcium, cobalt, copper, gold, iron, magnesium, manganese, nickel, tin, titanium, zinc and zirconium; and an inorganic anion selected from the group consisting of borate, bromide, chloride, iodide, nitrate, phosphate, sulfate and tetrafluoroborate;

(b) a minor amount of an epoxide having the formula:

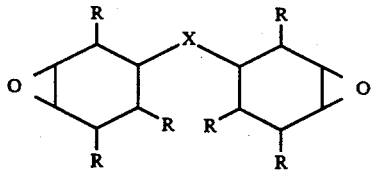

wherein X is a divalent organic radical containing 1 to 10 carbon atoms, from 0 to 6 oxygen atoms and from 0 to 6 nitrogen atoms; and each R is the same or different and is selected from the group consisting of hydrogen and lower aliphatic radicals; and (c) a major amount of a phosphate ester;

wherein the functional fluid has a wall current of less than 0.15 microamperes and wherein said metal salt is compatible with said epoxide in said functional fluid at a temperature of about 260° F.

2. The functional fluid according to claim 1 wherein said fluid contains 40 to 2000 parts per million of said metal salt.

3. The functional fluid according to claim 2 wherein the oxirane oxygen content of said fluid is 0.05 to 1.5 percent by weight.

4. The functional fluid according to claim 3 wherein said wall current is less than 0.10 microamperes.

5. The functional fluid according to claim 1 wherein the cation of said metal salt is selected from the group consisting of cadmium, calcium and zinc.

6. The functional fluid according to claim 5 wherein the cation of said metal salt is calcium or zinc.

7. The functional fluid according to claim 1 wherein the anion of said metal salt is a halogen selected from the group consisting of chloride, bromide and iodide.

8. The functional fluid according to claim 7 wherein the anion of said metal salt is chloride.

9. The functional fluid according to claim 1 wherein the anion of said metal salt is in an inorganic anion selected from the group consisting of borate, nitrate, phosphate, sulfate and tetrafluoroborate.

10. The functional fluid according to claim 1 wherein said metal salt is zinc chloride.

11. The functional fluid according to claim 3 wherein said epoxide is 2-(3,4-epoxycyclohexyl-5,5-spiro-3,4-epoxy)cyclohexane-meta-dioxane, 3,4-epoxycyclohexylmethyl-3,4-epoxycyclohexane carboxylate or bis(3,4-epoxycyclohexyl) adipate.

12. The functional fluid according to claim 4 wherein the phosphate ester is a mixed alkylaryl phosphate.

13. The functional fluid according to claim 12 wherein the phosphate ester is a mixture of trialkyl phosphate and triaryl phosphate.

14. The functional fluid according to claim 13 wherein the trialkyl phosphate is tributyl phosphate and the triaryl phosphate is tricresyl phosphate or triisopropylphenyl phosphate.

15. A functional fluid comprising:

(a) 5 to 5000 parts per million of a soluble streaming potential-inhibiting metal salt having a cation selected from the group consisting of barium, cadmium, calcium, cobalt, copper, gold, iron, magnesium, manganese, nickel, tin, titanium, zinc and zirconium; and an inorganic anion selected from the group consisting of borate, bromide, chloride, iodide, nitrate, phosphate, sulfate and tetrafluoroborate;

(b) a minor amount of an epoxide having the formula:

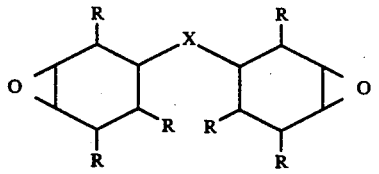

wherein X is a divalent organic radical containing 1 to 10 carbon atoms, from 0 to 6 carbon atoms and from 0 to 6 nitrogen atoms; and each R is the same or different and is selected from the group consisting of hydrogen and lower aliphatic radicals; and (c) a major amount of a phosphate ester;

wherein the functional fluid has a wall current of less than 0.15 microamperes and the acid number of said functional fluid does not exceed 1.5 milligrams of potassium hydroxide per gram of fluid when said fluid is heated for 168 hours at about 260° F. in the presence of copper and steel coupons.

16. The functional fluid according to claim 15 wherein said acid number of said functional fluid does not exceed 1.5 milligrams of potassium hydroxide per gram of fluid when said fluid is heated for 240 hours at about 260° F.

17. The functional fluid according to claim 16 wherein said acid number of said functional fluid does not exceed 1.5 milligrams of potassium hydroxide per gram of fluid when said fluid is heated for 14 days at about 260° F.

18. A functional fluid comprising:

(a) 5 to 5000 parts per million of a soluble streaming potential-inhibiting metal salt having a cation selected from the group consisting of barium, cadmium, calcium, cobalt, copper, gold, iron, magnesium, manganese, nickel, tin, titanium, zinc and zirconium; and an inorganic anion selected from the group consisting of borate, bromide, chloride, iodide, nitrate, phosphate, sulfate and tetrafluoroborate;

(b) an epoxide having the formula:

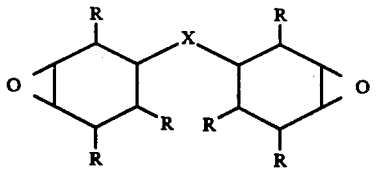

wherein X is a divalent organic radical containing 1 to 10 carbon atoms, from 0 to 6 oxygen atoms and from 0 to 6 nitrogen atoms; and each R is the same or different and is selected from the group consisting of hydrogen and lower aliphatic radicals in an amount sufficient to provide the fluid with an oxirane oxygen content of 0.05 to 1.5 percent by weight; and (c) a major amount of a phosphate ester;

wherein the functional fluid has a wall current of less than 0.15 microamperes and wherein the oxirane oxygen current of said functional fluid does not decrease by more than 50 percent when said fluid is heated for 96 hours at about 260° F. in the presence of copper and steel coupons.

19. The functional fluid according to claim 18 wherein said oxirane oxygen content of said functional fluid does not decrease by more than 40 percent when said fluid is heated for 96 hours at about 260° F.

20. The functional fluid according to claim 19 wherein said oxirane oxygen content of said functional fluid does not decrease by more than 20 percent when said fluid is heated for 96 hours at about 260° F.

21. A method of operating a hydraulic device wherein a displacing force is transmitted to a displacing member by means of a functional fluid, the improvement which comprises employing as said fluid the composition of claims 1, 6, 7, 9, 15 or 18.

* * * * *